United States Patent [19]

Dumont et al.

[11] Patent Number: 4,988,966

[45] Date of Patent: Jan. 29, 1991

[54] ELECTROMAGNET, PARTICULARLY FOR ACTUATING THE SWITCHES OF A CONTACT MAKER APPARATUS

[75] Inventors: Alain Dumont, Pontoise; Philippe Le Faou, Les Clayes Sous Bois, both of France

[73] Assignee: La Telemecanique Electrique, France

[21] Appl. No.: 330,543

[22] Filed: Mar. 30, 1989

[30] Foreign Application Priority Data

Mar. 31, 1988 [FR] France ..... 88 04263

[51] Int. Cl.[5] ..... H01F 7/13

[52] U.S. Cl. ..... 335/273; 335/274

[58] Field of Search ..... 335/131, 132, 194, 273, 335/274

[56] References Cited

U.S. PATENT DOCUMENTS

| | | | |
|---|---|---|---|
| 2,419,491 | 4/1947 | Gartner | 335/273 |
| 2,773,156 | 12/1956 | Lowry et al. | 335/272 X |
| 4,008,449 | 2/1977 | Morris et al. | 335/273 |
| 4,463,332 | 7/1984 | Everett | 335/273 |

*Primary Examiner*—George Harris

*Attorney, Agent, or Firm*—William A. Drucker

[57] ABSTRACT

An electromagnet is provided comprising a fixed yoke, a movable armature including a core concentric with an energization coil, and magnetizable plates separated from the yoke by a variable longitudinal air-gap, a return means providing the rest position of the armature, and a compensation device comprising a thin U shaped stirrup piece whose two legs cooperate with the ends of the plate, portions of this stirrup cooperate with inclined ramps of an adjustable rotary cam, placed concentrically with the core of the armature.

11 Claims, 3 Drawing Sheets

ELECTROMAGNET, PARTICULARLY FOR ACTUATING THE SWITCHES OF A CONTACT MAKER APPARATUS

BACKGROUND OF THE INVENTION

1. Field of the Invention

The invention relates to an electromagnet, in particular an electromagnet intended to actuate the switches of a contact-maker apparatus, comprising:

- a fixed yoke, a movable armature which is connected to these switches and which comprises a core concentric with an energization coil, as well as at least one magnetizable plate separated from the yoke by a variable longitudinal air-gap;
- a return means which cooperates longitudinally with the armature for conferring thereon a rest position when the coil is de-energized, and
- a concentric compensation spring disposed in an external region of the yoke opposite this air-gap, and whose forces antagonistic to this return means are only exerted over a fraction of the travel of the armature.

2. Description of the Prior Art

Such an electromagnet, which may be illustrated by the French Pat. No. 2 573 567 of the Applicant, is in particular applicable to small contact-makers, respectively automatic device relays, and has no means for progressive adjustment of the initial force of this compensation spring or its resilience.

The provision of an adjustment means is however desirable to the extent that it allows adaptation to the inevitable dispersion of the resilient properties which the return means may provide whereas its presence may also be used to guarantee that the electromagnet will operate cleanly when its coil is fed with the control voltage in a given environment.

Furthermore, the presence of a resilient compensation member or device may be necessary when the number of switches operatively opening and/or closing is not known beforehand.

The invention proposes consequently adding to an electromagnet such as defined above a compensation device of great simplicity offering an extended facility of progressive adjustment.

SUMMARY OF THE INVENTION

According to the invention, this object is reached because the compensation device comprises a thin U shaped stirrup piece whose two parallel legs cooperate longitudinally with lateral ends of the plate, whereas portions of this stirrup placed between the legs and the center of the resiliently deformable cross-piece which connects them together cooperate longitudinally with inclined bosses or ramps of an adjustable rotary cam, placed concentrically with the core of the armature.

BRIEF DESCRIPTION OF THE DRAWINGS

The invention as well as two embodiments to which it may lend itself, will be better understood from the following description, with reference to the accompanying eight figures which illustrate.

DESCRIPTION OF THE PREFERRED EMBODIMENTS

Figure 1:
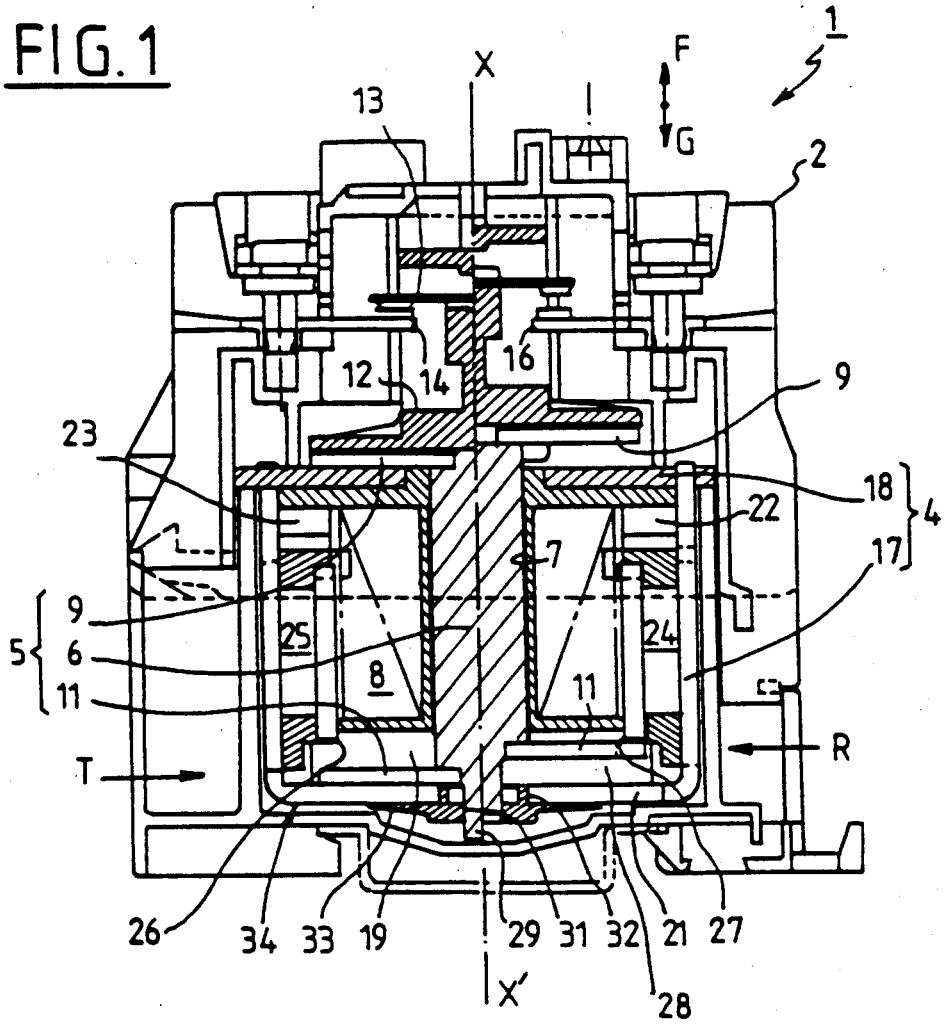
FIG. 1, a sectional and elevational view of a small contact-maker apparatus able to receive the compensation means of the invention, FIG. 2, a sectional side view of the electromagnet used in FIG. 1, FIG. 3, a bottom view of the electromagnet concerned in FIGS. 1 and 2, showing a first compensation means, FIG. 4, a bottom view of an electromagnet including a modification of the compensation means, FIG. 5, a perspective view of a molded part adapted for playing a role of bearing and adjustment member, FIG. 6, a local sectional view of a modification of the compensation means, and FIGS. 7 and 8, a bottom view and an axial sectional view of a constructional modification.

A small contact-maker apparatus 1, visible in FIG. 1, comprises in an insulating case 2 and electromagnet 3 with a fixed yoke 4 and a movable armature 5. The latter includes a central core 6 which slides axially along XX' in a bore 7 of an energization coil 8 and which receives two opposite plates 9 and 11.

The upper plate 9 is associated with a contact holder 12 receiving mobile switch parts, such as 13, which cooperate with fixed contact parts such as 14, 16.

In the type of electromagnet which is used in this contact-maker, the fixed yoke 4 has the form of a magnetizable circuit closed through the association of a U shaped part 17 and a spacer 18.

The lower plate 11 is placed in a longitudinal space 19 situated between a front face of the coil and a cross-piece 21 of the U shaped part, whereas two lateral spaces 22, 23 are occupied by permanent magnets 24, 25 exerting magnetic attractions on facing edges of plate 11. This plate is movable between a rest position R, shown in the right hand half of FIG. 2 and a work position T, seen in the other half of the figure.

In the rest condition, the plate is urged in direction F, in the immediate vicinity against pole pieces 26, 27 and is separated from cross-piece 21 by a working air-gap 28, whereas in the work condition, the situation is reversed.

The return function provided by the permanent magnets could, if required, be entrusted to a conventional return spring without requiring a modification of the structure of the resilient compensation means which will be described hereafter.

Figure 2:
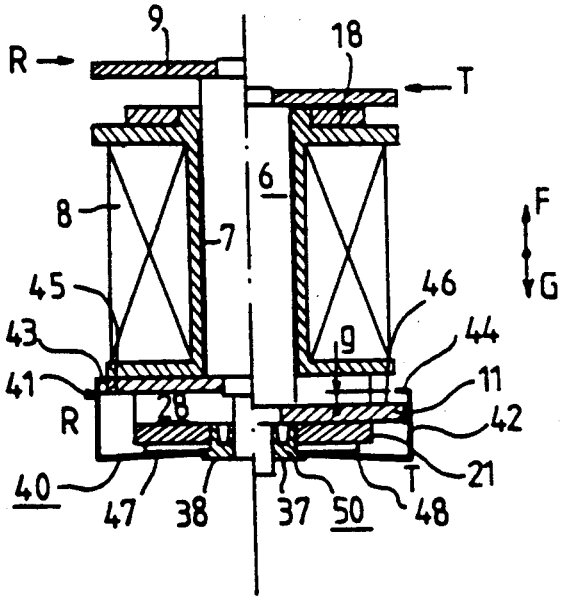

As can be seen in FIGS. 1 and 2, a smooth end 29 of the core is received in a synthetic material bearing 31, clamped appropriately in a concentric opening 32 in cross-piece 21 with respect to which it may be oriented angularly.

Figure 3:
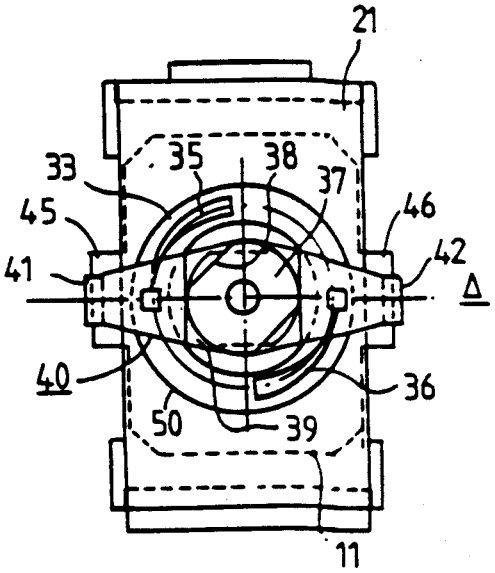
Figure 5:
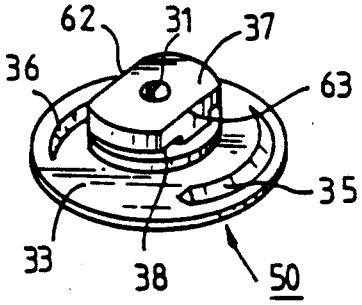

The bearing has, on the side opposite the air-gap, a projecting collar 33 of a general circular shape, see FIGS. 3 and 5, which is applied on one side against face 34 of the cross-piece and which has on the opposite side two circular ribs 35, 36 extending in the radial direction; between these ribs and the bore of the bearing is located a cylindrical boss 37 passing through a central opening 38 formed in the cross-piece 39 of a thin resilient stirrup 40, in the shape of a U, which it holds axially in position.

This bearing, these ribs and this boss may belong to one and the same molded piece 50.

Each of two parallel legs 41, 42 of this stirrup has, at its end, a hook 43 respectively 44 cooperating with an extension 45 respectively 46 of the lower plate 11. This cooperation, as can be seen in FIG. 2, is provided both angularly to the extent that the legs are guided in direction Δ by the edges of the extensions and longitudinally because of the presence of the hooks which come into contact at the end of a free travel -g-.

Two regions 47, 48 of the stirrup, which are placed between the center of opening 38 and the corresponding legs are resiliently applied against the ribs, for example because of a slight curvature which is given during manufacture to the cross-piece of the stirrup. As can be seen in FIG. 2, hooks 43, 44 communicate to plate 11 in the work position an antagonistic force in direction G which results from a resilient deformation of the cross-piece whereas in the rest position, no contact is established between the hooks and the plate.

The position of the plate in which such deformation is established or interrupted depends on the height that the rib presents locally, and so on the angular position which is given to part 50. An appropriate position may be communicated because of the presence of flats 62, 63 at the end of the boss.

Because of the angular mobility of this part 50, it is therefore possible to progressively adjust the initial force which is exerted on the plate and on the armature in direction G, which is opposite that F along which the return forces act.

Figure 4:
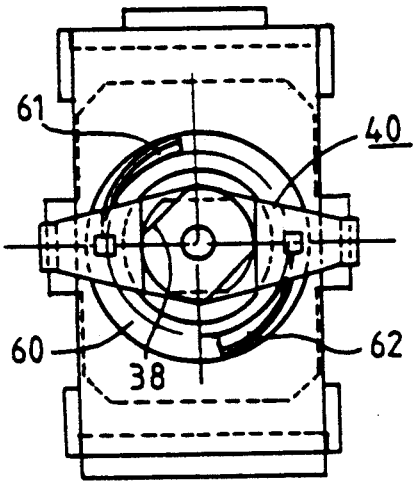

In a second embodiment of the adjustable part 60 shown in FIG. 4, the paths of ribs 61, 62 are no longer circular, but extend along spiral portions; rotation of this adjustable part causes then not only modification of the value of the initial force $G_o$ applied by the hooks to the armature but further causes a modification of the increase in resilient forces which the stirrup communicates to the armature during a fraction of its travel.

The choice of an embodiment of the electromagnet in which the fixed mobile parts as well as the coil form an indissociable sub-assembly, subsequently housed in the case, makes it possible to adjust the forces of the compensation spring in the factory, without it being then necessary to provide an access opening in this case.

Such adjustment may be advantageously provided through an automated installation comprising more especially a supply source for the coil, a reduction motor whose output shaft is coupled to the adjustment part, a device for simulating the forces developed by the switches, and a detection means operative for stopping the motor as soon as a change of state of the armature occurs.

Figure 6:
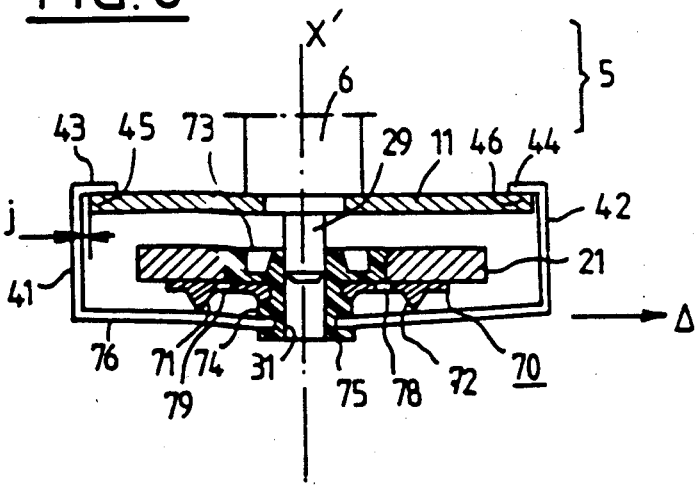

If it is feared that parasite friction may appear between the edges of extensions 45, 46 and legs 41, 42 of the stirrup, a variant permits the stirrup to keep an orientation Δ through other means (see FIG. 6).

In this variant, the adjustment part 70 with cam ribs 71, 72 is no longer fixed angularly with the bearing 73 in which the end 29 of the core slides.

This bearing, which is axially snap-fitted into cross-piece 21 of yoke 4 and remains angularly secured thereto, has a shoulder 74 which holds the adjustment part 70 axially in position and an extension 75 in which the central region 79 of stirrup 76 is anchored angularly and axially.

The adjustment part 70 may be driven for example through the presence of two holes 77, 78 in which the operator, or an automatic apparatus, may introduce an appropriate tool.

A clearance J is formed between legs 41, 42 and ends 45, 46 of plate 11.

Figure 7:
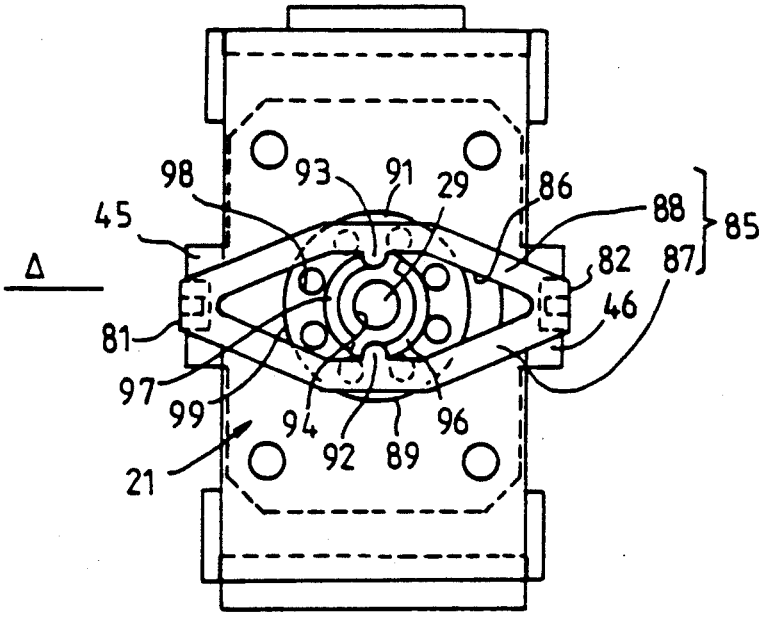
Figure 8:
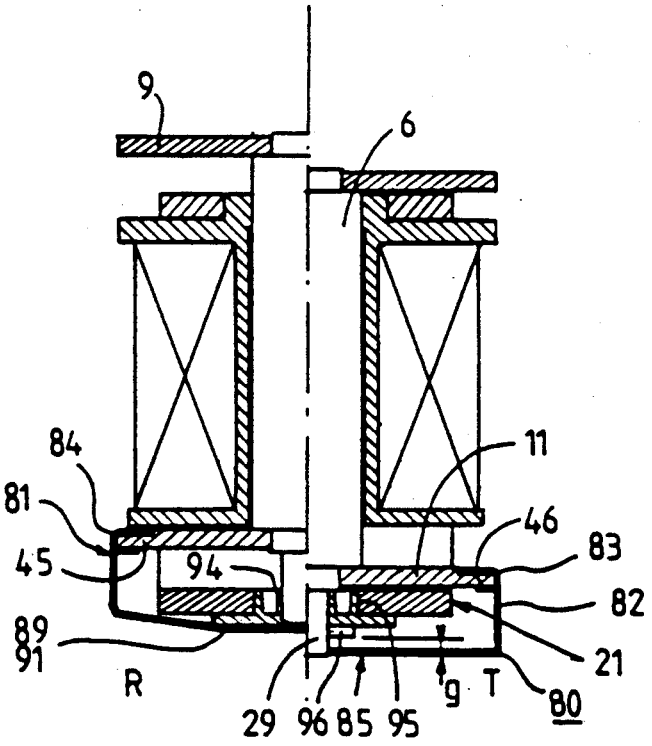

In another variant, see FIGS. 7 and 8, a resilient stirrup 80 in the form of a U having two parallel legs 81, 82 is secured, for example by means of forks or end clips 83, 84 thereof, to opposite ends 45, 46 of plate 11, so as to move at the same time as the latter.

Between the legs this stirrup has a cross-piece 85 with an opening 86 placed between two symmetrical portions 87, 88.

The central regions 89, 91 of these portions each have an extension 92 respectively 93, directed towards the axis of a bushing 90 of bearing 94 receiving the smooth end 29 of core 6.

This bearing 94, which is disposed in an opening 95 of the magnetizable cross-piece 21 in a way similar to that shown in FIG. 6 for bearing 73, has, in order to fulfil the function of adjustable cam, two curved and slanting ramps 96, 97 extending symmetrically with respect to the axis of the bearing and situated respectively facing the two extensions 92, 93 with which a longitudinal cooperation is established when, following de-energization of the coil, the movable armature comes to the rest position.

The level of the resilient forces communicated to the movable armature in the rest position is adjusted by communicating to bearing 9 4, for example through openings such as 98 in its projecting collar 99, an appropriate orientation which is then kept because of the friction forces which bind it to the cross-piece.

Here again, the resilient force is communicated to the armature at the end of a free travel -g-, measured between the extensions and the points of the facing ramps.

What is claimed is:

1. An electromagnet, in particular an electromagnet intended to actuate the switches of a contact-maker apparatus, comprising:

a fixed yoke, a movable armature which is connected to these switches and which comprises a core concentric with an energization coil, as well as at least one magnetizable plate separated from the yoke by a variable longitudinal air-gap, a return means which cooperates longitudinally with the armature for conferring thereon a rest position when the coil is de-energized, and a concentric compensation spring disposed in an external region of the yoke opposite this air-gap, and whose forces antagonistic to this return means are only exerted over a fraction of the travel of the armature, wherein the said compensation device comprises a thin U shaped stirrup piece whose two parallel legs cooperate longitudinally with lateral ends of the plate, whereas portions of this stirrup placed between the legs and the center of the resiliently deformable cross-piece which connects them together cooperate longitudinally with inclined bosses or ramps of an adjustable rotary cam, placed concentrically with the core of the armature.

2. The electromagnet as claimed in claim 1, wherein said adjustable cam has a guide bearing for one end of said coil.

3. The electromagnet as claimed in claim 1, wherein said adjustable cam is adjusted rotatively in an opening belonging to a portion of the fixed yoke of the electromagnet.

4. The electromagnet as claimed in claim 1, wherein said adjustable cam has an extension which is directed on the side opposite the core and which receives a central opening of said resilient stirrup.

5. The electromagnet as claimed in claim 1, wherein said resilient stirrup is held in an angular direction by cooperation of its legs with extensions of a plate of said armature.

6. The electromagnet as claimed in claim 4, wherein said adjustable cam comprises a bearing for receiving one end of the core of the armature and receives the resilient stirrup on said extension.

7. The electromagnet as claimed in claim 1, wherein said adjustable cam is held concentrically in position by an independent part, fixed to the yoke and having a bearing for the end of said movable core and comprising an extension on which the central region of said stirrup is fixed.

8. The electromagnet as claimed in claim 1, wherein the ends of the legs of said resilient stirrup have hooks cooperating with the ends of said plate at the end of a free adjusted travel.

9. The electromagnet as claimed in claim 1, wherein said stirrup is made fast with extensions of said plate and has, in central regions, extensions coming respectively opposite circular inclined ramps and coming into contact therewith at the end of a free adjusted travel.

10. The electromagnet as claimed in claim 9, wherein fixing between the extensions of said plate and said stirrup is provided by means of clips or forks placed at the ends of the legs, whereas said inclined ramps are carried by a projecting collar of a bearing receiving a guide end of said armature.

11. The electromagnet as claimed in claim 1, wherein said stirrup has a central opening allowing axial movement of the end of the core fitted into the bearing.

* * * * *